US006535078B1

(12) United States Patent
Okada et al.

(10) Patent No.: US 6,535,078 B1
(45) Date of Patent: Mar. 18, 2003

(54) DIELECTRIC FILTER, DIELECTRIC DUPLEXER, AND COMMUNICATION SYSTEM

(75) Inventors: Takahiro Okada, Ishikawa-ken (JP); Jinsei Ishihara, Kanazawa (JP); Hideyuki Kato, Ishikawa (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 09/653,491

(22) Filed: Aug. 31, 2000

(30) Foreign Application Priority Data

Sep. 3, 1999 (JP) ..... 11-250249
Jul. 18, 2000 (JP) ..... 2000-217842

(51) Int. Cl.[7] ..... H01P 1/20
(52) U.S. Cl. ..... 333/134; 333/206
(58) Field of Search ..... 333/134, 206, 333/202, 203, 207, 222, 223

(56) References Cited

U.S. PATENT DOCUMENTS 5,945,896 A * 8/1999 Miyamoto ..... 333/206
6,154,951 A * 12/2000 Ito et al. ..... 29/600

FOREIGN PATENT DOCUMENTS

JP 766607 3/1995
JP 11-177314 7/1999 ..... 333/206
JP 11-239005 8/1999 ..... 333/206
KR 1999-80297 A 11/1999

OTHER PUBLICATIONS

Korean Office Action dated Jun. 25, 2002.

* cited by examiner

*Primary Examiner*—Robert Pascal
*Assistant Examiner*—Kimberly E Glenn
(74) *Attorney, Agent, or Firm*—Dickstein, Shapiro, Morin & Oshinsky, LLP.

(57) ABSTRACT

A dielectric filter and a dielectric duplexer with improved out-of-band attenuation characteristics in the vicinity of the pass band without changing the pass band characteristics. Inner conductor forming holes are formed from one end face to the opposite end face of a dielectric block, and inner conductors are formed on the respective inner surfaces. An outer conductor is formed over substantially the entire outer surface of the dielectric block. On one side surface of the dielectric block, substantially parallel to the inner conductors, outer conductor gaps are provided in at least one area disposed between a pair of inner conductors, extending between the opposite end faces.

12 Claims, 6 Drawing Sheets

DIELECTRIC FILTER, DIELECTRIC DUPLEXER, AND COMMUNICATION SYSTEM

BACKGROUND OF THE INVENTION

1. Field of the Invention

The present invention relates to a dielectric filter and a dielectric duplexer each having a plurality of inner conductors formed in a dielectric block, and having an outer conductor formed on the outer surface thereof, and to a communication system using them.

2. Description of the Related Art

A well known dielectric filter structure is shown in FIG. 12. This dielectric filter has a dielectric block 1 having a substantially rectangular prism shape. Three inner conductor forming holes 2*a,* 2*b,* and 2*c* are formed from one end face to the opposite end face of the dielectric block 1, and inner conductors 3*a,* 3*b,* and 3*c* are formed on the respective inner surfaces. A pair of input-output electrodes 5*a* and 5*b* are provided on the outer surface of the dielectric block 1. An outer conductor 4 is formed over substantially the entire outer surface except the areas where the input-output electrodes 5*a* and 5*b* are formed. Each of the inner conductor forming holes 2*a,* 2*b,* and 2*c* is a stepped hole, and each of the inner conductors 3*a* to 3*c* has a gap g in the larger inner-diameter portion, in the vicinity of the end face, and this portion constitutes an open end of a resonator formed by the corresponding inner conductor.

In this dielectric filter, a $\lambda/4$ resonator is formed by each of the inner conductors 3*a* to 3*c*. This dielectric filter is constructed with inductive coupling between these resonators by arranging the smaller inner-diameter portions eccentrically, and by stray capacitance generated in the gaps g, whereby this dielectric filter has an attenuation pole in a higher frequency area of the pass band.

The conventional construction as described above, however, can not always achieve sufficient out-of-band attenuation. Accordingly, various methods have hitherto been adopted for improving the out-of-band attenuation characteristics, such as providing a coupling element or a coupling substrate to provide resonance poles, increasing the number of stages, adding another filter, and the like. However, these methods raise problems, in that they increase the number of components, increase the filter size, and increase the cost. In addition, the pass band characteristics can be significantly changed.

SUMMARY OF THE INVENTION

The present invention can avoid these problems and provide a dielectric filter and a dielectric duplexer capable of improving the out-of-band attenuation characteristics in the vicinity of the pass band without changing the pass band characteristics, and a communication system using the dielectric filter and duplexer.

The dielectric filter and dielectric duplexer in accordance with the present invention comprise a dielectric block having a substantially rectangular prism shape; a plurality of inner conductor forming holes arranged between the opposite end faces of the dielectric block; and a plurality of inner conductors formed on the inner surfaces of the plurality of inner conductor forming holes; and an outer conductor formed on the outer surface of the dielectric block. In this dielectric filter, on at least one side surface of the dielectric block, substantially parallel to the longitudinal axes of the inner conductors, an elongated outer conductor gap is provided in at least one portion of at least one area between a pair of adjacent inner conductors.

The outer conductor gap is arranged so as to block ground currents flowing between the two input/output electrodes. Thus it may be arranged generally transverse to the ground currents. Strict parallelism with the inner conductors is not absolutely necessary, but is considered to be preferable.

The gap may extend between the opposite end faces or only part way across the dielectric block. The gap may have various shapes. More than one gap may be provided.

In accordance with the above-described features, since one or more outer conductor gap is provided at an area between a pair of adjacent inner conductors, the degree of coupling between the pair of resonators is reduced and the influence of the TEM mode is suppressed. Thus, the out-of-band attenuation in the vicinity of the pass band can be increased substantially without changing the pass band characteristics, as described hereinafter. The reason for this is considered to be as follows. Providing outer conductor gaps on the outer surface of a dielectric block changes the ground current flowing through the outer conductor and thereby changes the attenuation characteristics. However, providing them exclusively in areas between adjacent inner conductors influences the degree of coupling between resonators very little, and thereby hardly changes the pass band characteristics. That is, required filter characteristics can be easily realized by a simple method in which an outer conductor gaps are provided at predetermined locations on the outer surface of the dielectric block.

Furthermore, since a communication system in accordance with the present invention is constructed of the dielectric filter or the dielectric duplexer having the above-described features, it is inexpensive, small-sized, and superior in its characteristics.

Other features and advantages of the present invention will become apparent from the following description of the invention which refers to the accompanying drawings.

DESCRIPTION OF EMBODIMENTS OF THE INVENTION

Figure 1:
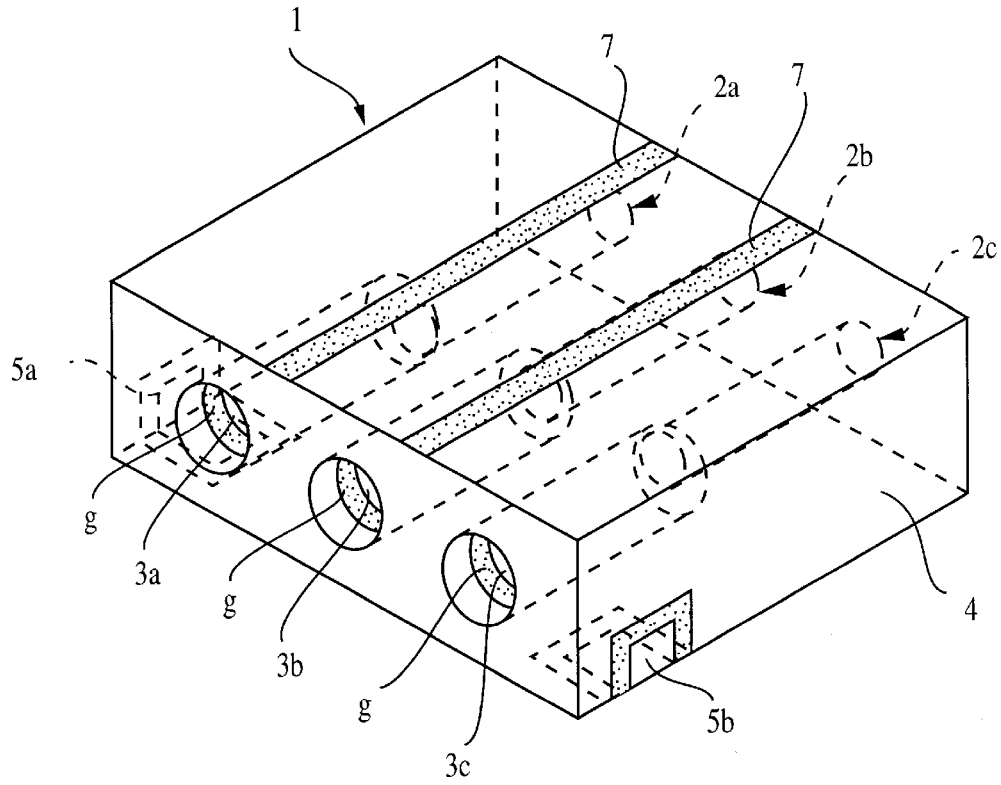
FIG. 1 is a perspective view showing the appearance of a dielectric filter in accordance with a first embodiment of the present invention.
Figure 2:
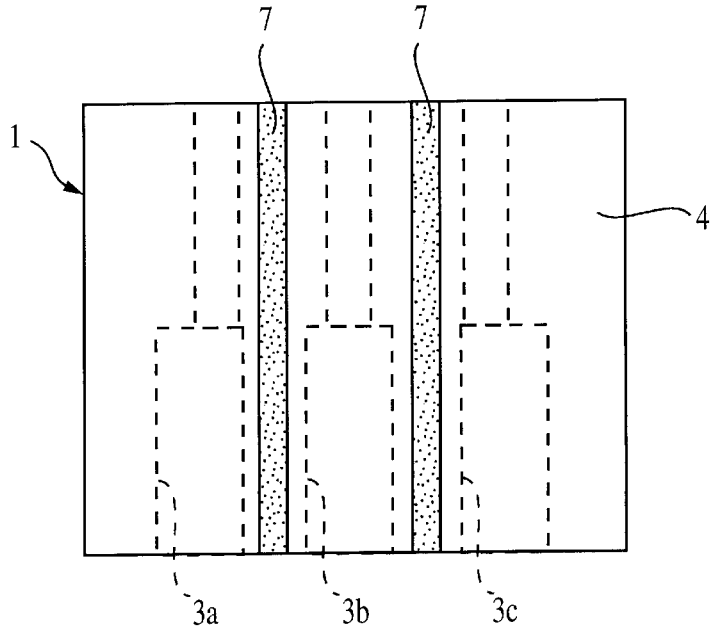
FIG. 2 is a plan view showing the dielectric filter in FIG. 1.

The construction of the dielectric filter in accordance with a first embodiment will now be described with reference to FIGS. 1 and 2. FIG. 1 is a perspective view showing this dielectric filter, and FIG. 2 is a plan view thereof. Hereinafter, shaded portions in the figures represent portions where an outer conductor has been removed from the dielectric block, possibly by grinding, or where no outer conductor has been formed.

The dielectric filter in accordance with this embodiment comprises a dielectric block 1 having substantially the shape of a rectangular prism (hexahedron). Three inner conductor forming holes 2*a*, 2*b*, and 2*c* are formed from one end face to the opposite end face of the dielectric block 1, and inner conductors 3*a*, 3*b*, and 3*c* are formed on the respective inner surfaces. The inner conductor forming holes 2*a* to 2*c*, and consequently the inner conductors 3*a* to 3*c* are arranged substantially in a common plane and substantially parallel to each other in the dielectric block 1. An outer conductor 4 is formed over substantially the entire outer surface of the dielectric block 1.

Each of the inner conductor forming holes 2*a* to 2*c* is a stepped hole of which the inner diameter changes at substantially the intermediate portion in the axial direction of the inner conductor forming hole. In each of the inner conductor forming holes, a gap g is provided in the larger inner-diameter portion in the vicinity of one end face of the dielectric block. This portion serves as an open end of the respective resonator formed of the corresponding one of the inner conductors 3*a* to 3*c*. More specifically, on the side of the open end face (the end face on the front surface side in FIG. 1), each of the inner conductors 3*a* to 3*c* is separated from the outer conductor 4 by the corresponding gap g. On the other hand, each of the inner conductors 3*a* to 3*c* is connected (short-circuited) to the outer conductor 4 at the other end face (the end face on the rear surface side in FIG. 1), that is, this end face serves as a short-circuited end face.

A pair of input-output electrodes 5*a* and 5*b* separated from the outer conductor 4 are provided at predetermined locations on the outer surface of the dielectric block 1.

In addition, on one side surface (the top surface in FIG. 1) of the dielectric block 1, parallel to the inner conductors 3*a* to 3*c*, a pair of outer conductor gaps 7 are provided respectively in the area between the inner conductors 3*a* and 3*b* and the area between the inner conductors 3*b* and 3*c*, between the opposite end faces. Each of the outer conductor gaps 7 is formed into a strip shape in the axial direction of the inner conductors 3*a* to 3*c*, and as shown in FIG. 2, the width thereof is set so as to be smaller than the pitch between each two adjacent inner conductors, and not to overlap any of the inner conductors 3*a* to 3*c* in the plan view. The outer conductor gaps 7 can be formed by removing the outer conductor 4 at predetermined locations after the outer conductor 4 has been formed over substantially the entire outer surface of the dielectric block 1. Alternatively, the outer conductor gaps 7 can be provided by forming the outer conductor 4 on all portions of the outer surface of the dielectric block 1 except at the outer conductor gaps 7. This dielectric filter is mounted on a mounting (circuit) board, using the bottom surface shown in FIG. 1 as a mounting surface.

In this embodiment, although the outer conductor gaps 7 are provided on the top surface of the dielectric block 1, they also may be provided on the bottom surface of the dielectric block 1. Typically, when one side surface is used as a mounting surface as in this embodiment, the outer conductor gaps 7 are provided on the side surface opposite to the mounting surface.

In this dielectric filter, a $\lambda/4$ resonator is formed by each of the inner conductors 3*a* to 3*c*.

In this dielectric filter, inductive coupling between the resonators is provided by the eccentricity of smaller inner-diameter portions of the resonators, and by stray capacitance generated in the inner conductor gaps g, whereby this dielectric filter has an attenuation pole in a higher frequency area of pass band. The dielectric filter achieves external coupling by capacitance generated between the input-output electrodes 5*a* and 5*b* and the inner conductors 3*a* and 3*c* opposing them. In the present embodiment, the attenuation pole is provided only in a higher frequency area of the pass band, by moving the smaller inner-diameter portions of the inner conductors 3*a* to 3*c* off-center, toward each other, and thereby increasing the degree of inductive coupling. Alternatively, however, attenuation poles may be provided respectively in both the lower and the higher frequency areas of the pass band, by making one of the smaller inner-diameter portions of the inner conductors 3*a* and 3*c* coaxial with the corresponding larger inner-diameter portion, thus making one of the couplings between adjacent resonators a capacitive coupling due to the stepped holes.

Figure 3A:
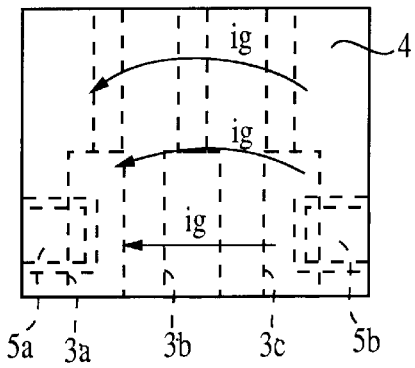
FIGS. 3A and 3B are diagrams for explaining the operation of the outer conductor gaps in the present invention.
Figure 3B:
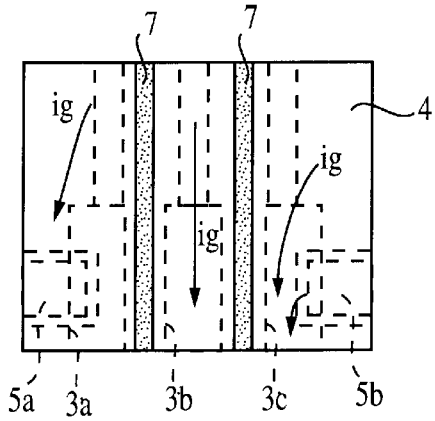
Figure 12:
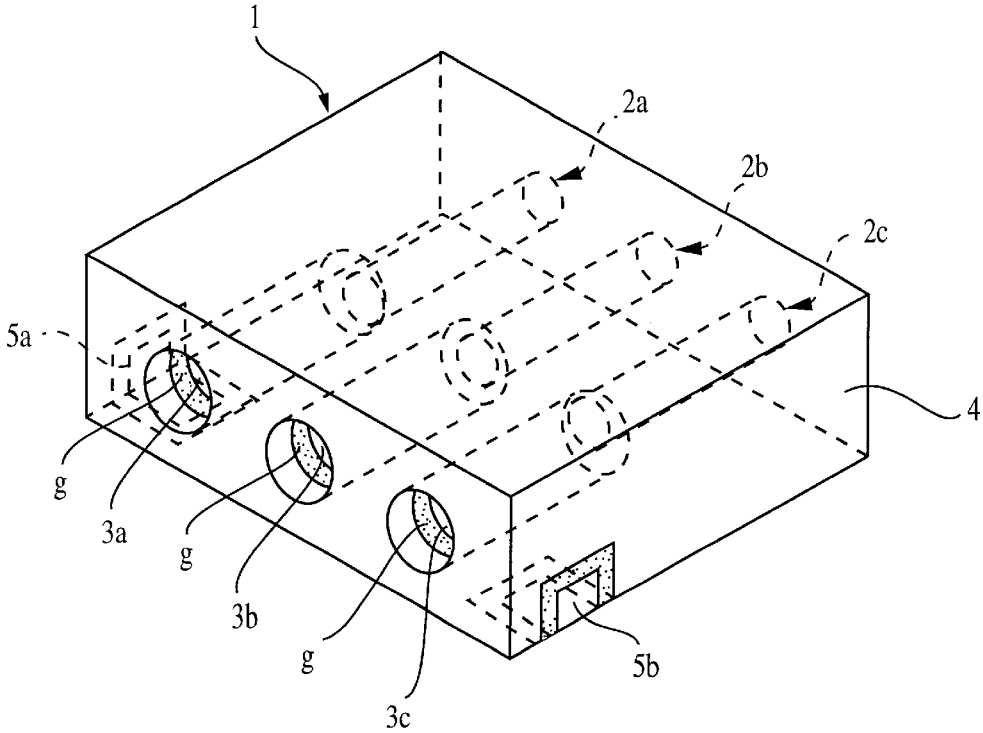
FIG. 12 PRIOR ART
FIG. 12 is a perspective view showing the appearance of a conventional dielectric filter.

Next, the operation of the outer conductor gaps in accordance with the present invention will be described. FIGS. 3A and 3B schematically illustrate the ground current ig at a particular time flowing through the outer conductor on the top surface of the dielectric filter. FIG. 3A shows the flowing of the ground current ig in the construction without the outer conductor gaps 7 (the conventional construction shown in FIG. 12). On the other hand, FIG. 3B shows the ground current ig in the construction of this embodiment. Without the outer conductor gaps 7, as shown in FIG. 3A, the ground current ig flows through the outer conductor from one input-output side directly into the other input-output side, and causes a parasitic inductance, which deteriorates the out-of-band attenuation characteristics. On the other hand, when the outer conductor gaps 7 are provided as in this embodiment, as shown in FIG. 3B, the ground current ig flowing through the outer conductor is obstructed by the outer conductor gaps 7, that is, the ground current ig cannot flow from one input-output side directly into the other input-output side, which results in the elimination or reduction of the above-mentioned parasitic inductance. This improves the out-of-band attenuation characteristics.

Figure 4:
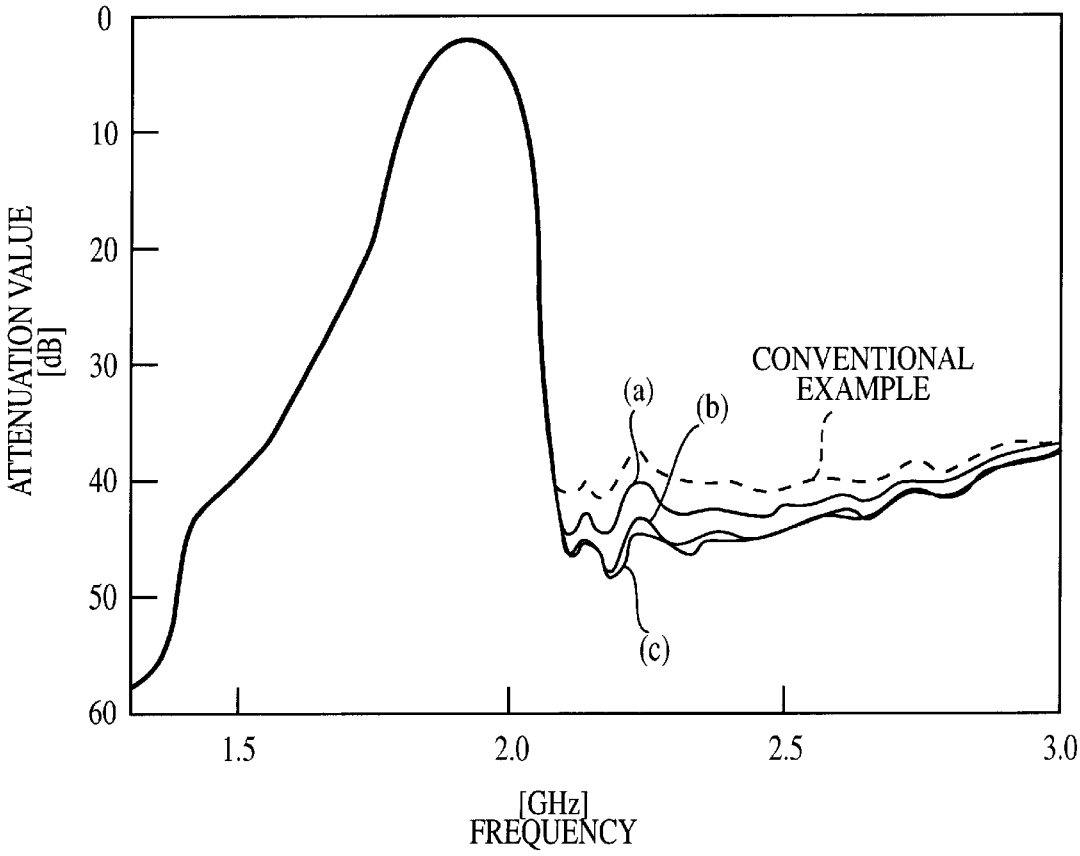
FIG. 4 is a graph showing the attenuation characteristics of the dielectric filter of the present invention and those of a conventional dielectric filter.
Figures 5A, 5B, 5C:
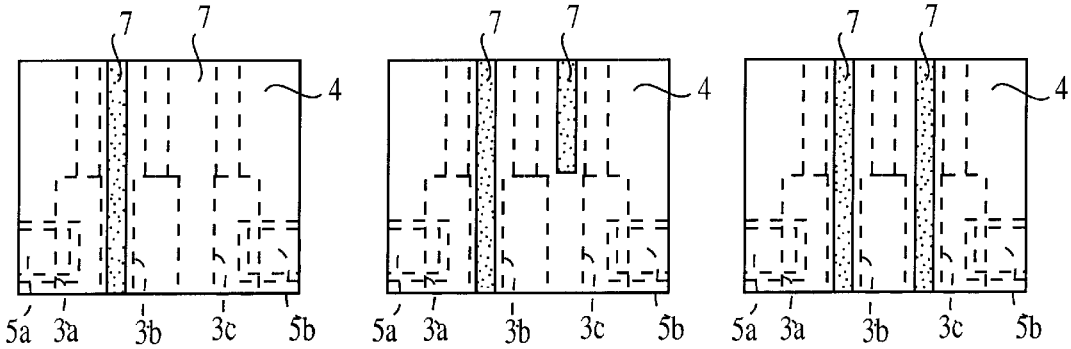
FIGS. 5A, 5B and 5C are diagrams showing the outer conductor gaps corresponding respectively to the attenuation characteristics shown in FIG. 4.

Next, the effectiveness of the construction of this embodiment will be described based on experimental results. FIG. 4 illustrates the attenuation characteristics of the dielectric filter of this embodiment and those of the dielectric filter with the conventional construction. Solid lines (a), (b), and (c) shown in FIG. 4 represent the attenuation characteristics corresponding to the cases where the outer conductor gaps 7 have the configurations shown respectively in FIGS. 5A, 5B, and 5C. Broken lines represent the attenuation characteristics of the conventional example. Each of these two filters has a width (the length along the common plane of the inner conductors) of 5.6 mm, an axial length of 4.6 mm, a thickness of 2.0 mm, and a resonance frequency of about 2 GHz. They are identical in construction except for the outer conductor gaps 7. In this embodiment, the width of each of the outer conductor gaps 7 was set to 0.5 mm.

As shown in FIG. 4, this embodiment is substantially equal to the conventional example in its overall pass band characteristics (central frequency, insertion loss, and pass band width). However, the out-of-band attenuation at the high frequency side of the pass band gradually increases, as the area of the outer conductor gaps 7 increases, as shown in FIG. 5.

In the dielectric filter in accordance with the present invention, it is thus possible to improve the out-of-band attenuation characteristics substantially without changing the pass band characteristics by the simple method of forming outer conductor gaps at predetermined locations on the side surface where they block the ground current in the outer conductor (in this example substantially parallel to the longitudinal axes of the inner conductors), and to easily achieve required attenuation characteristics by changing the number and/or the size of the outer conductor gaps.

Figure 6:
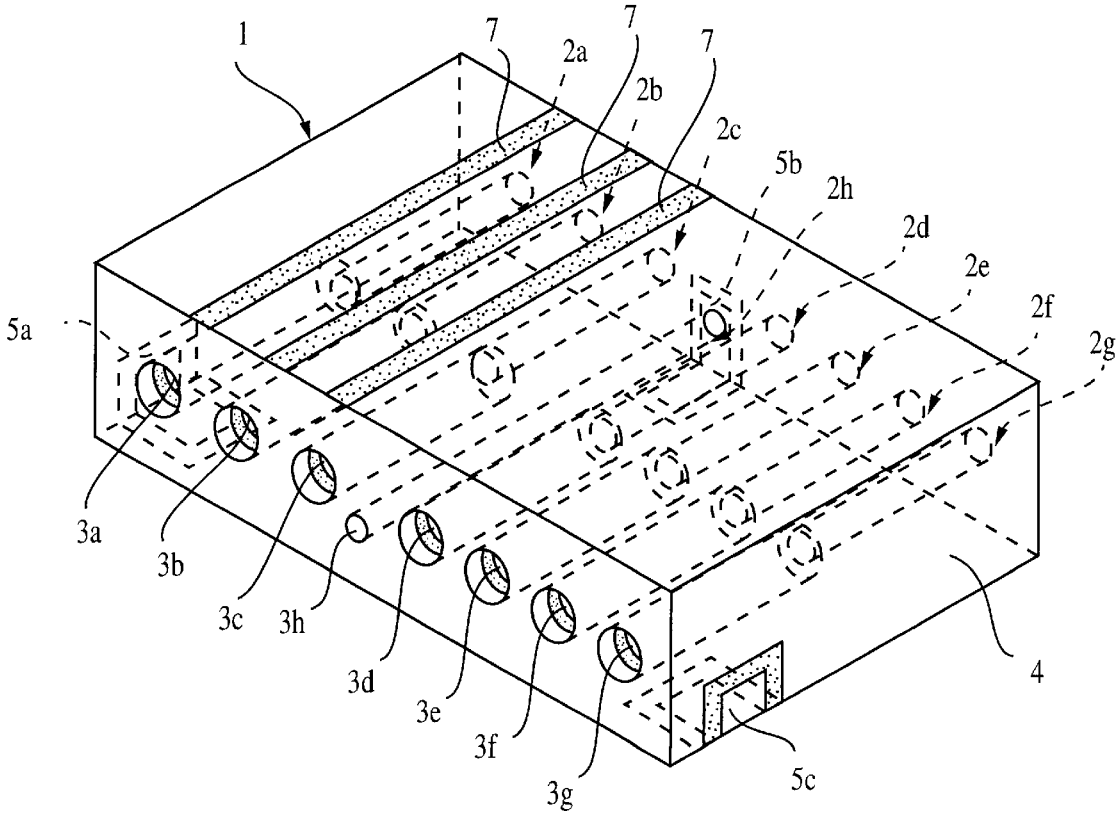
FIG. 6 is a perspective view showing the appearance of a dielectric duplexer in accordance with a second embodiment of the present invention.
Figure 7:
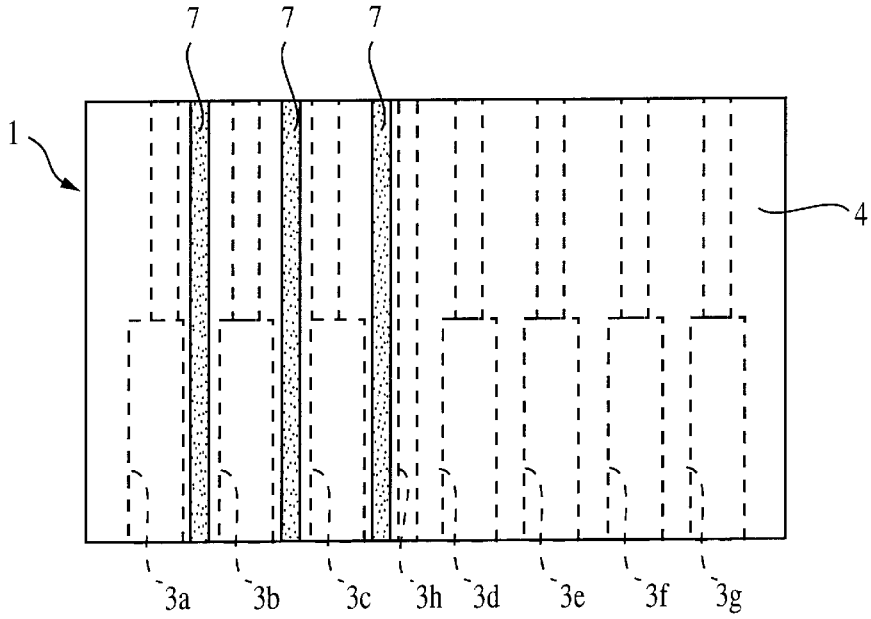
FIG. 7 is a plan view showing the dielectric duplexer in FIG. 6.

Next, the construction of a dielectric duplexer in accordance with a second embodiment of the present invention is shown in FIGS. 6 and 7. In this dielectric duplexer, the transmission-side has a band pass filter comprising three stages of resonators, and the reception-side has a band pass filter comprising four stages of resonators, in the dielectric block having a rectangular prism shape. The central frequency of the transmission-side filter in this example is set to be lower than that of the reception-side filter.

Inner conductor forming holes 2*a* to 2*c* for constructing the resonators of the transmission-side, inner conductor forming holes 2*d* to 2*g* for constructing the resonators of the reception-side, and an inner conductor forming hole 2*h* for obtaining an external coupling common to both filters, are formed between the opposite end faces of the dielectric block 1. Inner conductors 3*a* to 3*h* are formed on the inner surfaces of the inner conductor forming holes 2*a* to 2*h*, respectively. The inner conductors 3*a* to 3*h* are arranged in the dielectric block 1 in line substantially linearly. An outer conductor 4 is formed over substantially the entire outer surface of the dielectric block 1. Each of the inner conductor forming holes 2*a* to 2*g* is a stepped hole, and each has an inner conductor (electrode) gap g in the vicinity of the end face of the larger inner-diameter portion.

Input-output electrodes 5*a*, 5*b*, and 5*c*, separated from the outer conductor 4, are formed at respective predetermined locations on the outer surface of the dielectric block 1. The input-output electrode 5*a* is a transmission terminal, and the input-output electrode 5*c* is a reception terminal. The input-output electrodes 5*a* and 5*c* are formed across two side faces adjacent to the inner conductors 3*a* and 3*g*, respectively, and near the open end of the dielectric block 1. The input-output electrode 5*b* is an antenna terminal common to both filters, and is formed across a side face and the short-circuited end face of the dielectric block. The inner conductor 3*h* in the inner conductor forming hole 2*h* is connected with the outer conductor 4 at the open end face, and is connected with the input-output electrode 5*b* at the short-circuited end face.

Furthermore, on one side surface (the top surface in FIG. 1) of the dielectric block 1, parallel to the arranging direction of inner conductors 3*a* to 3*h*, outer conductor gaps 7 are provided respectively in the areas between inner conductors 3*a* and 3*b*, between inner conductors 3*b* and 3*c*, and between inner conductor 3*c* and 3*h*, and between the opposite end faces. Each of the outer conductor gaps 7 is formed in a strip (elongated rectangular) shape in the axial direction of the inner conductors 3*a* to 3*h*, and as shown in FIG. 7, the width thereof is set so as to be smaller than the pitch between two adjacent inner conductors, and not to overlap any of the inner conductors 3*a* to 3*c* and 3*h* in the plan view.

In this dielectric duplexer, the input-output electrodes 5*a* and 5*c* are capacitively coupled with the respective inner conductors 3*a* and 3*g* opposing them, and the duplexer achieves an external coupling by the corresponding external coupling capacitance. Electromagnetic field coupling (interdigital coupling in this embodiment) exists between the inner conductor 3*h* and the adjacent inner conductors 3*c* and 3*d*, thereby providing external coupling.

The inner conductors 3*a* to 3*c* of the transmission-side filter have substantially the same construction as in the first embodiment, and likewise, the transmission-side filter has attenuation poles at a higher frequency side of the pass band.

In the construction of this dielectric duplexer, since, on the top surface of the dielectric block 1 of a transmission side filter, outer gaps 7 are provided in areas between adjacent inner conductors, the out-of-band attenuation characteristics at the higher frequency side of the pass band of the transmission side filter is improved as shown in FIG. 4. That is, the transmission-side filter is provided with improved attenuation within the pass band of the reception-side filter.

In the above-described embodiments, the outer conductor gaps 7 are formed extending between the opposite end faces on the top surface of the dielectric block 1, but the arrangement of the outer conductor gaps 7 is not necessarily limited to this method. In the above embodiments, an outer conductor gap is formed in at least one portion of at least one area between adjacent inner conductors, on a side face of the dielectric block.

Figure 8:
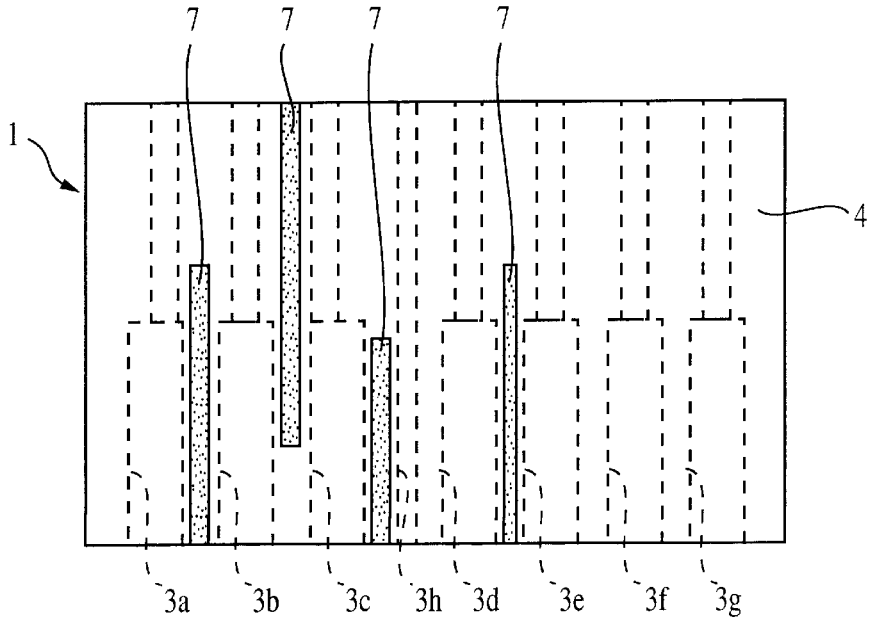
FIG. 8 is a plan view showing a dielectric duplexer in accordance with a third embodiment of the present invention.
Figure 9:
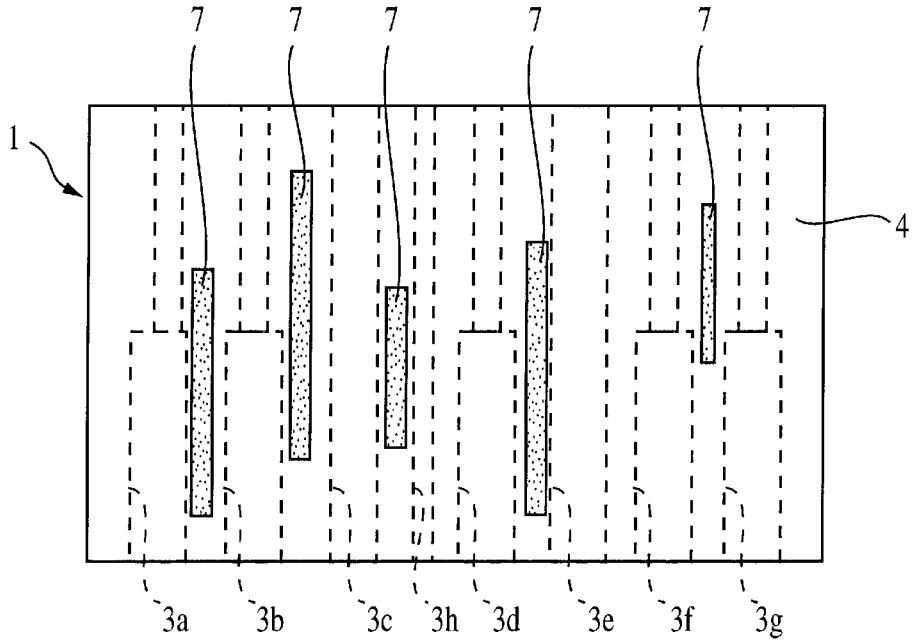
FIG. 9 is a plan view showing a dielectric duplexer in accordance with a fourth embodiment of the present invention.
Figure 10:
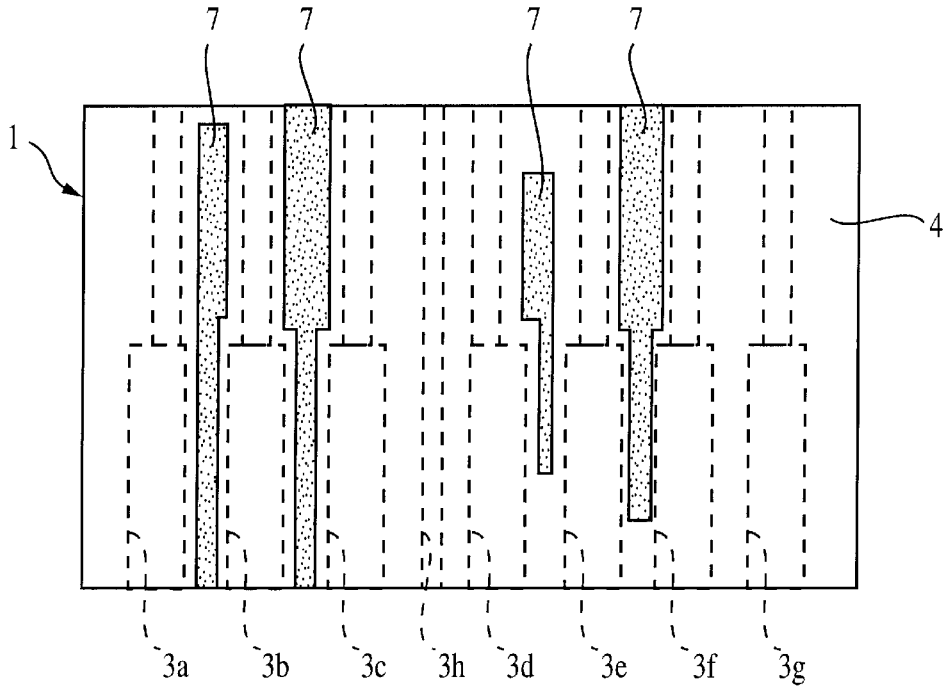
FIG. 10 is a plan view showing a dielectric duplexer in accordance with a fifth embodiment of the present invention.

Dielectric duplexers in accordance with other embodiments of the present invention are shown in FIGS. 8 through 10.

FIG. 8 shows a dielectric duplexer in accordance with a third embodiment of the present invention. In this dielectric duplexer, outer conductor gaps 7 having respective predetermined lengths are formed along the top surface of the dielectric block 1, extending from either one of the end faces. An outer conductor gap 7 is provided between inner conductors 3*d* and 3*e* of the reception-side filter.

FIG. 9 shows a dielectric duplexer in accordance with a fourth embodiment of the present invention. In this dielectric duplexer, outer conductor gaps 7 are provided only at the central portion of the top surface of the dielectric block 1.

FIG. 10 shows a dielectric duplexer in accordance with a fifth embodiment of the present invention. In this dielectric duplexer, outer conductor gaps 7 are each formed into stepped-shapes corresponding to the shapes of the inner conductors.

More generally, the different shapes of the outer conductor gaps 7 in the above-described embodiments may be mixed with each other to form a dielectric filter or dielectric duplexer. The distribution of the ground current flowing through the outer conductor 4 is changed according to where the input-output electrodes and the ground electrode are formed. Therefore, if a location where the density of the ground current is large is situated on a side of the dielectric block near an end face, the outer conductor gaps 7 can be provided near the end face, as shown in FIG. 8. On the other hand, if the location where the density of the ground current is large is situated at the central portion of the dielectric block, the outer conductor gaps 7 can be provided at the central portion, as shown in FIG. 9.

The shape (width, length, and position) of each outer conductor gap is thus set in accordance with the pitch between the inner conductors, the shapes of the inner conductors, the size of the dielectric block, and the locations of the input-output and ground electrodes, and the shape is chosen further so as not to influence the pass band characteristics (insertion loss, or degree of coupling between resonators). Also, as shown in FIGS. 8 through 10, the outer conductor gaps 7 may be provided on either or both of the transmission-side and reception-side filters.

In addition, the inner conductor forming holes are not limited to being stepped holes, but may be straight holes having a constant inner diameter along their length. Also, the shape of the cross section of an inner conductor forming hole is not limited to being a circular shape, but may be another shape such as a polygonal shape, e.g., a rectangular shape, or an elliptical shape. Furthermore, the inner conductor forming holes may be constructed by mixing ones having different shapes.

In the above-described embodiments, the open ends of the resonators were provided by the inner conductor gaps arranged at the same end of all of the inner conductors. However, alternatively, the open ends of the resonators may be formed by ends of the inner conductor forming holes at an open end face of the dielectric block where no outer conductor is formed. Also, the explanation was based on comb-line coupling, in which the open ends of all of the resonators are at one end face of the dielectric block. However, the open ends of the resonators may be at different end faces.

Figure 11:
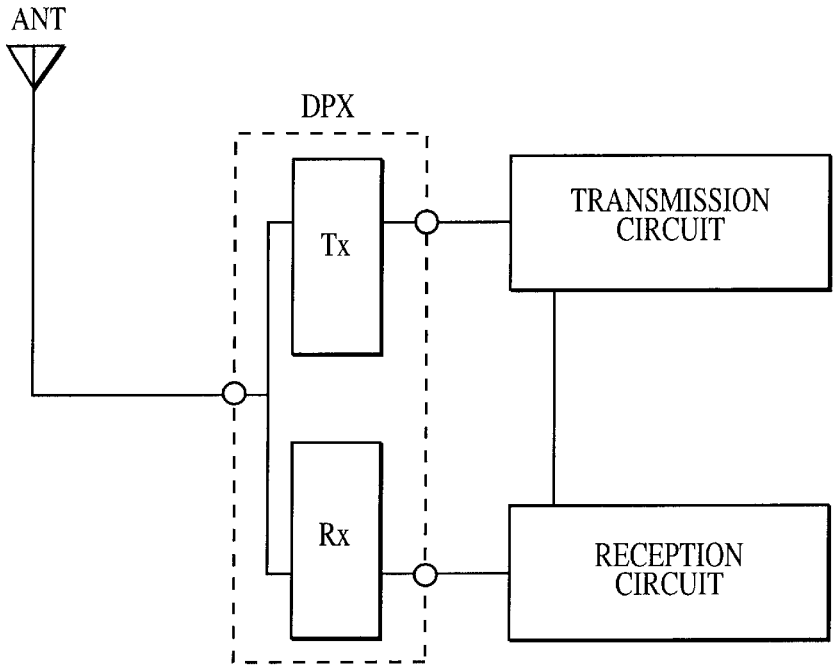
FIG. 11 is a block diagram showing a communication system in accordance with a sixth embodiment of the present invention.

Next, the construction of a communication system in accordance with a sixth embodiment of the present invention is shown in FIG. 11. In FIG. 11, ANT represents an antenna, DPX a duplexer, Tx a transmission filter, and Rx a reception filter. This communication system is constructed by connecting the antenna terminal of the duplexer DPX to the antenna ANT, connecting the transmission terminal of the transmission filter Tx to a transmission circuit, and connecting the reception terminal of the reception filter Rx to a reception circuit.

Here, any one of the above-described dielectric filters or dielectric duplexers can be used as the transmission filter Tx, the reception filter Rx, or the duplexer DPX. By using the dielectric filter or the dielectric duplexer in accordance with the present invention, a communication system which is small-sized, inexpensive, and superior in characteristics can be realized.

As described herein, since the dielectric filter or dielectric duplexer comprises outer conductor gaps in areas disposed between the inner conductors, it is possible to improve out-of-band attenuation characteristics in the vicinity of the pass band substantially without changing the pass band characteristics. In accordance with the present invention, therefore, the dielectric filter and dielectric duplexer are inexpensive, small-sized, and superior in characteristics.

Moreover, by using the dielectric filter or the dielectric duplexer in accordance with the present invention, a communication system which is inexpensive, small-sized, and superior in characteristics can be achieved.

While the invention has been described in connection with embodiments thereof, many modifications and variations based on the present invention are possible in the light of the above teachings. It is therefore to be understood that within the scope of the appended claims, the invention may be practiced otherwise than as specifically described.

What is claimed is:

1. A dielectric filter comprising:

a dielectric block having a substantially rectangular prism shape with a plurality of side surfaces extending between a pair of opposite end faces;

a plurality of inner conductor forming holes arranged between the opposite end faces of said dielectric block;

a plurality of inner conductors formed on inner surfaces of said plurality of inner conductor forming holes; and an outer conductor formed on said dielectric block, wherein on at least one of the side surfaces of said dielectric block, the outer conductor has an elongated gap provided in at least one area between a pair of adjacent inner conductors, said gap being substantially parallel to said inner conductors; and wherein said gap extends completely across said side surface between said opposite end faces of the dielectric block.

2. A dielectric filter comprising:

a dielectric block having a substantially rectangular prism shape with a plurality of side surfaces extending between a pair of opposite end faces;

a plurality of inner conductor forming holes arranged between the opposite end faces of said dielectric block;

a plurality of inner conductors formed on inner surfaces of said plurality of inner conductor forming holes; and an outer conductor formed on said dielectric block, wherein on at least one of the side surfaces of said dielectric block, the outer conductor has an elongated gap provided in at least one area between a pair of adjacent inner conductors, said gap being substantially parallel to said inner conductors;

wherein said gap extends partially across said side surface; and wherein said gap extends to one of said end faces.

3. A dielectric filter comprising:

a dielectric block having a substantially rectangular prism shape with a plurality of side surfaces extending between a pair of opposite end faces;

a plurality of inner conductor forming holes arranged between the opposite end faces of said dielectric block;

a plurality of inner conductors formed on inner surfaces of said plurality of inner conductor forming holes; and an outer conductor formed on said dielectric block, wherein on at least one of the side surfaces of said dielectric block, the outer conductor has an elongated gap provided in at least one area between a pair of adjacent inner conductors, said gap being substantially parallel to said inner conductors; and wherein said gap has a non-constant width.

4. A dielectric filter comprising:

a dielectric block having a substantially rectangular prism shape with a plurality of side surfaces extending between a pair of opposite end faces;

a plurality of inner conductor forming holes arranged between the opposite end faces of said dielectric block;

a plurality of inner conductors formed on inner surfaces of said plurality of inner conductor forming holes; and an outer conductor formed on said dielectric block, wherein on at least one of the side surfaces of said dielectric block, the outer conductor has an elongated gap provided in at least one area between a pair of adjacent inner conductors, said gap being substantially parallel to said inner conductors;

wherein a second elongated gap is arranged in a second area between a second pair of adjacent inner conductors; and wherein said gap and said second gap have different lengths.

5. A dielectric filter comprising:

a dielectric block having a substantially rectangular prism shape with a plurality of side surfaces extending between a pair of opposite end faces;

a plurality of inner conductor forming holes arranged between the opposite end faces of said dielectric block;

a plurality of inner conductors formed on inner surfaces of said plurality of inner conductor forming holes; and an outer conductor formed on said dielectric block, wherein on at least one of the side surfaces of said dielectric block, the outer conductor has an elongated gap provided in at least one area between a pair of adjacent inner conductors, said gap being substantially parallel to said inner conductors;

wherein a second elongated gap is arranged in a second area between a second pair of adjacent inner conductors; and wherein said gap and said second gap have different widths.

6. A dielectric filter comprising:

a dielectric block having a substantially rectangular prism shape with a plurality of side surfaces extending between a pair of opposite end faces;

a plurality of inner conductor forming holes arranged between the opposite end faces of said dielectric block;

a plurality of inner conductors formed on inner surfaces of said plurality of inner conductor forming holes; and an outer conductor formed on said dielectric block, wherein on at least one of the side surfaces of said dielectric block, the outer conductor has an elongated gap provided in at least one area between a pair of adjacent inner conductors, said gap being substantially parallel to said inner conductors;

wherein a second elongated gap is arranged in a second area between a second pair of adjacent inner conductors; and wherein said gap and said second gap have different shapes.

7. A dielectric duplexer comprising:

at least two filters formed in said dielectric block, wherein at least one of said filters is a dielectric filter comprising:

a dielectric block having a substantially rectangular prism shape with a plurality of side surfaces extending between a pair of opposite end faces;

a plurality of inner conductor forming holes arranged between the opposite end faces of said dielectric block;

a plurality of inner conductors formed on inner surfaces of said plurality of inner conductor forming holes; and an outer conductor formed on said dielectric block, wherein on at least one of the side surfaces of said dielectric block, the outer conductor has an elongated gap provided in at least one area between a pair of adjacent inner conductors, said gap being substantially parallel to said inner conductors;

each of said filters having a respective pair of input/output electrodes, one input/output electrode of each of said filters being connected together to serve as a common input/output terminal, the other input/output electrode of one of said filters serving as a transmission terminal, and the other input/output terminal of the other of said filters serving as a reception terminal.

8. A communication system comprising a dielectric duplexer as claimed in claim 7; further comprising a transmission circuit connected to said transmission terminal, and a reception circuit connected to said reception terminal.

9. A communication system as claimed in claim 8, further comprising an antenna connected to said common input/output terminal.

10. A dielectric filter comprising:

a dielectric block having a substantially rectangular prism shape with a plurality of side surfaces extending between a pair of opposite end faces;

a plurality of inner conductor forming holes arranged between the opposite end faces of said dielectric block;

a plurality of inner conductors formed on inner surfaces of said plurality of inner conductor forming holes;

an outer conductor formed on said dielectric block; and a pair of input/output electrodes formed on respective portions of said side surfaces of said dielectric block, said input/output electrodes being coupled to respective ones of said inner conductors for connecting said filter in an RF circuit;

wherein a ground current flows in said outer conductor when an RF signal is applied to said filter;

wherein on at least one of said side surfaces of said dielectric block, a gap is formed in an area where said gap blocks said ground current; and wherein said ground current generates a parasitic inductance, and said gap reduces said parasitic inductance.

11. A dielectric filter comprising:

a dielectric block having a substantially rectangular prism shape with a plurality of side surfaces extending between a pair of opposite end faces;

a plurality of inner conductor forming holes arranged between the opposite end faces of said dielectric block;

a plurality of inner conductors formed on inner surfaces of said plurality of inner conductor forming holes;

an outer conductor formed on said dielectric block; and a pair of input/output electrodes formed on respective portions of said side surfaces of said dielectric block, said input/output electrodes being coupled to respective ones of said inner conductors for connecting said filter in an RF circuit;

wherein a ground current flows in said outer conductor when an RF signal is applied to said filter;

wherein on at least one of said side surfaces of said dielectric block, a gap is formed in an area where said gap blocks said ground current; and wherein said gap is elongated in shape and is arranged generally transverse to said ground current.

12. A dielectric filter as claimed in claim 11, wherein said gap is arranged substantially parallel to said inner conductors.

* * * * *